US005277474A

United States Patent [19]

Hannagan et al.

[11] Patent Number: 5,277,474

[45] Date of Patent: Jan. 11, 1994

[54] CUSHION

[75] Inventors: Angus P. D. Hannagan, Havant; Michael A. McGrath, Hampshire, both of England

[73] Assignee: Medimatch Limited, Havant, England

[21] Appl. No.: 744,502

[22] Filed: Aug. 14, 1991

[30] Foreign Application Priority Data

Aug. 14, 1990 [GB] United Kingdom ..... 9017798
Aug. 14, 1990 [GB] United Kingdom ..... 9017799

[51] Int. Cl.[5] ..... A47C 3/00
[52] U.S. Cl. ..... 297/284.1; 5/455
[58] Field of Search ..... 297/284.1, DIG.; 5/453, 5/455; 128/33; 137/625.22, 625.23, 625.65, 487.5, 224.5, 226; 417/304, 21, 36

[56] References Cited

U.S. PATENT DOCUMENTS

| | | | |
|---|---|---|---|
| 2,626,446 | 1/1953 | Moore | 137/487.5 |
| 2,684,672 | 7/1954 | Summerville | 297/284.1 |
| 2,719,986 | 10/1955 | Rand | 128/33 X |
| 3,148,391 | 9/1964 | Whitney | 128/33 |
| 3,199,124 | 8/1965 | Grant | 128/33 |
| 3,297,023 | 1/1967 | Foley . | |
| 4,193,149 | 3/1980 | Welch . | |
| 4,389,742 | 6/1983 | DeWitt | 5/455 |
| 4,622,706 | 11/1986 | Takeuchi | 128/33 X |
| 4,711,275 | 12/1987 | Ford et al. . | |
| 4,796,948 | 1/1989 | Paul et al. | 297/284.1 |
| 4,840,425 | 6/1989 | Noble . | |
| 4,864,671 | 9/1989 | Evans | 5/453 |
| 4,890,344 | 1/1990 | Walker | 297/DIG. 3 |
| 4,986,738 | 1/1991 | Kawasaki et al. | 5/455 X |
| 5,022,385 | 6/1991 | Harza | 128/33 |
| 5,117,518 | 6/1992 | Schild | 5/453 |

FOREIGN PATENT DOCUMENTS

| | | | |
|---|---|---|---|
| 2807038 | 8/1979 | Fed. Rep. of Germany | 5/455 |
| 2919438 | 11/1980 | Fed. Rep. of Germany . | |
| 1456058 | 10/1966 | France . | |
| 959103 | 5/1964 | United Kingdom | 5/453 |
| 1595417 | 8/1981 | United Kingdom . | |

*Primary Examiner*—Laurie K. Cranmer
*Attorney, Agent, or Firm*—Larson and Taylor

[57] ABSTRACT

A cushion for the seat of a chair, has at least two groups of inflatable tubes arranged in a side-by-side relationship and oriented in a direction corresponding to the front to back direction of the chair seat. The tubes of each group are inflatable together. The first group is a single tube or two or more adjacent tubes, and the other group is at least two spaced apart tubes arranged on opposite sides of the first group of tubes. The groups of tubes are inflatable sequentially. Symmetrical but periodically varying support for the user is thus provided.

8 Claims, 4 Drawing Sheets

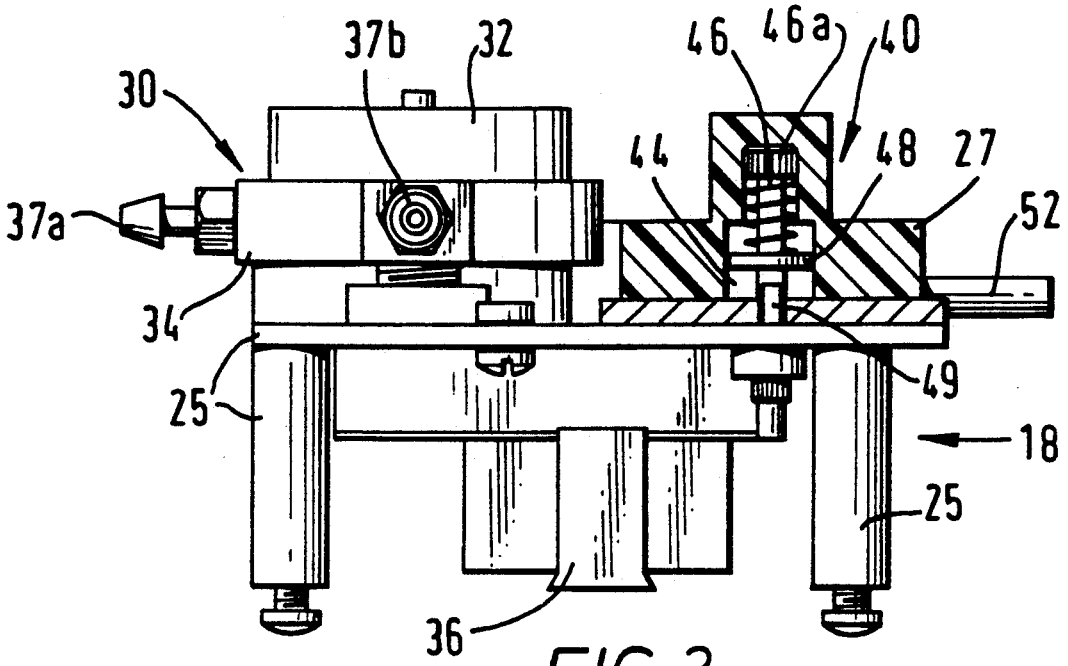
FIG. 3
FIG. 4
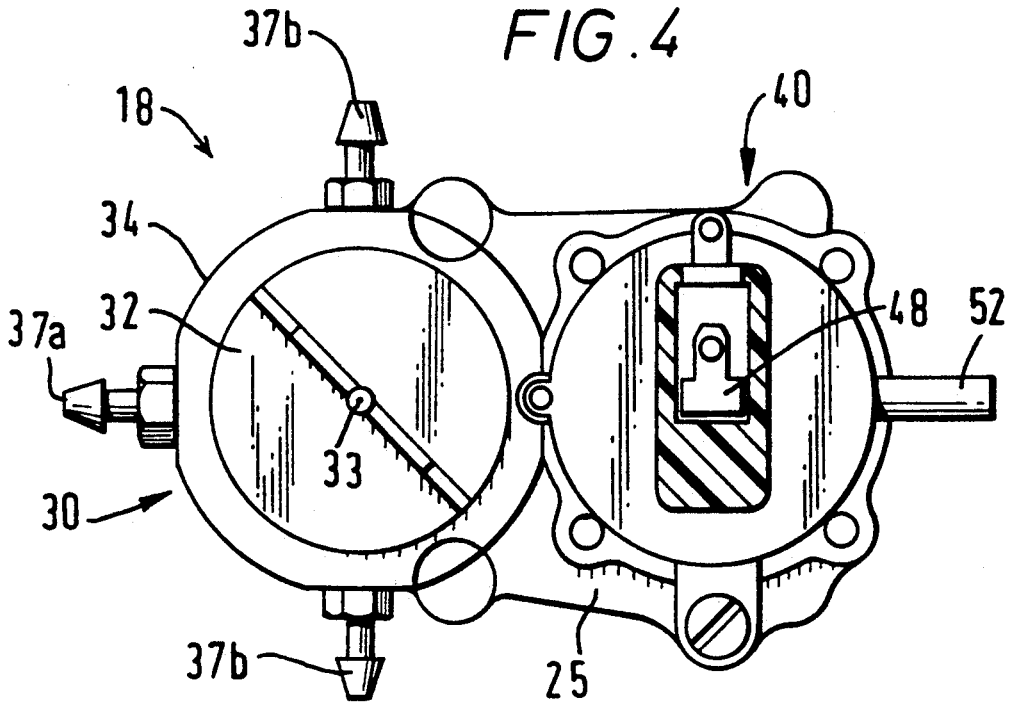

CUSHION

BACKGROUND OF THE INVENTION

1. Field of the invention

This invention relates to inflatable cushions, particularly cushions for wheelchairs, and to control devices for such cushions and other cellular inflatable human body supports.

2. Description of the prior art

It is well-known that people such as the disabled who are confined to a bed or a wheelchair for long periods of time frequently suffer from sores, which result from areas near the surface of the skin being deprived of blood due to pressure exerted on those areas by the bodily support under the person's body weight. In the context of beds it is known, for example from GB-A-1595417, to provide a mattress, comprising an array of hollow flexible tubes which are sequentially inflated and deflated, so that ripples travel along the length of the mattress. Thus, while a person's body is continuously supported by the mattress the actual regions of the body in contact with the mattress which bear the body weight change with time. This prevents any one area of the body being continuously deprived of blood and thus discourages the formation of sores.

There have been a number of attempts at applying a similar principle to seats for chairs and in particular wheelchairs, but up to now none has been particularly successful. The present inventors believe that in the context of a chair a rippling effect, as in the known mattress, is not suitable, because the support area for the body is smaller and a chair support demands a much higher degree of stability, i.e. it is important for the person to be always supported in the chair substantially vertically, without a tendency to tip in any one direction as the supporting areas on the body surface change. There is therefore a need for a cushion for a chair, which cushion continuously supports a person's body in a substantially vertical condition, with the regions of the cushion in contact with the body and thus bearing the body weight changing sequentially with time. It is one object of this invention to meet this need.

Mattresses having groups of inflatable cells and control systems for them are well known and are described for example in U.S. Pat. No. 4193149 and U.S. Pat. No. 4711275. Because such mattresses are primarily for use by patients who are incapable of moving themselves or can move only with difficulty, their control systems are complex.

Someone in a chair, e.g. a wheelchair, however, may not require such an elaborate and fail-safe control system. Power requirement should be minimized, since mains supply is not available. It is another object of the present invention to provide an inflation and a control device which is simple yet effective and requires little power.

SUMMARY OF THE INVENTION

In accordance with the invention in one aspect, there is provided a cushion for the seat of a chair, the cushion comprising at least two groups of inflatable tubes arranged in a side-by-side relationship and oriented in a direction corresponding to the front to back direction of the chair seat. The tubes of each group are inflatable together, the tubes of a first group being a single tube or two or more adjacent tubes and the tubes of the or each other group being two or more spaced apart tubes arranged on opposite sides of said first group of tubes. The groups of tubes are inflatable sequentially. Thus the groups of tubes which support the body weight of a person sitting in the chair alternates with time.

The cushion of the invention thus comprises a plurality of tubes which are inflatable sequentially such as to always provide a symmetrical support about a central line corresponding to the front to back direction of the chair for supporting a person's body seated in the chair.

Another advantage of the invention is that it can reproduce mechanically the lifting exercises which chairbound people often perform with the aim of preventing the formation of sores. In many cases such exercises can be difficult and uncomfortable. In the invention, however, the sequential inflation of the tubes of the cushion imitates mechanically the action of lifting the various supporting regions of the body surface, without the need for the person consciously and physically performing such exercises.

In a preferred embodiment of the invention there are four tubes, the two inner tubes being inflatable together to form the first group and the two outer tubes being inflatable together to form the second group. The advantage of this conformation is that whichever group of tubes is in the inflated condition, there is always a symmetrical arrangement of supporting means for the person sitting in the chair. This feature, together with the tubes being orientated in a direction corresponding to the front to back direction of the chair seat, assists in providing a cushion of high stability which supports a person's body substantially vertically at all times.

The cushion of the invention preferably forms a central supporting region of the chair seat, which in any case is normally the area of the seat which actually contacts the person's body when seated in the chair. The portions of the seat surrounding the tubes may form a support frame for the tubes, at least on two sides and preferably on all four sides. Such portions may be formed of a conventional cushioning material, preferably a high density foam, or may be a permanently inflated cell or cells.

According to the present invention there is also provided a chair, especially a wheelchair, having a seat which includes a cushion as defined above.

The sequential inflating of the different groups of tubes may be controlled by any suitable means. Desirably, an automatic control device, e.g. battery operated, is used to deliver inflating fluid such as air, e.g. from a compressor, to the different groups of tubes sequentially over a predetermined cycle. The control means can conveniently be situated beneath the cushion or seat of the chair. In the case of a wheelchair, the control means and its power supply (as well as the inflating fluid supply) should be self-contained and transportable with the chair.

In the preferred embodiment of the invention, a cycle of inflation is as follows:

(i) inflate first group of tubes to maximum inflation;
(ii) deflate second group of tubes;
(iii) inflate second group of tubes to maximum inflation;
(iv) deflate first group of tubes;
(v) repeat from step (i).

By "maximum inflation" is meant the desired degree of inflation for enabling each group of tubes to fulfil its supporting function. This degree of inflation may vary, depending upon the desired conditions of use of the cushion. A timing sequence for the cycle may be chosen to suit the desired conditions of use. For example, each respective group of tubes may remain in its fully inflated condition for a period of time before the changeover procedure to the other group of tubes is commenced. Similarly, a time delay may be included between steps (ii) and (iii) and between steps (iv) and (v), in order to allow those areas of the body supported by the respective groups of inflated tubes to "recover" and the blood supply to those areas to be renewed.

Deflation of the tubes is preferably also governed by the control device and may conveniently be accomplished by use of an inflating fluid distributor device as disclosed in U.S. Pat. No. 4193149, the disclosure of which is incorporated herein by reference. Deflation of the tubes may alternatively be carried out by means of a bleed valve or alternatively through any other suitable leakage device, will be appreciated by persons skilled in the art. Such leakage may be from the tubes of one group to the tubes of another group. Alternatively each group of tubes may be inflated and deflated independently.

The present invention in another aspect provides a control device for the cushion of the invention described above or other cellular inflatable body support particularly one having cells in the form of elongate parallel inflatable tubes, adapted to supply inflating fluid selectively to cells of the body support. The control device has pressurised fluid supply means, and a pressurised fluid distributor having an inlet connected to the fluid supply means, a plurality of outlets connectible to the cells of the body support and means for sequentially connecting said inlet to said outlets to effect inflation of the cells in a predetermined sequence. Pressure-responsive control means are provided for the fluid supply means, having a sensor of pressure at the inlet of the distributor and being arranged to control the fluid supply means in dependence on the pressure sensed by the sensor.

Preferably, the fluid supply means is power-operated, e.g. is one or more pumps or compressors, and the pressure-responsive control means effects on-off control of power supply to the fluid supply means.

Thus, when a selected cell or group of cells of the cushion is connected to the inflating fluid supply via the distributor means, if the fluid pressure in that cell or group of cells is below a predetermined minimum, the supply means are actuated to replenish the inflating fluid in that cell or group of cells, thereby inflating them to their functional condition in which they provide support for a person's body.

The distributor typically operates in a predetermined continuous cycle and connects the outlets to the inlet in a predetermined sequence, to enable the cells or groups of cells to be inflated in sequence over each cycle.

Preferably, as the changeover from one cell or group of cells to another occurs, the preceding cell or group of cells will not deflate until after the succeeding tube or group of tubes has completed or nearly completed its inflation, in order to maintain the cushion at all times in a supporting condition. Deflation is preferably controlled by the distributor. Deflation may alternatively be achieved by the operation of a bleed valve or other suitable leakage device provided preferably at or near each distributor outlet.

The control means for the fluid supply means preferably comprises an electric microswitch connected to the fluid supply means. The operation of the microswitch is preferably performed by the expansion and contraction of a sac of fluid-impermeable flexible material (hereinafter "pressure sac") whose interior is in fluid communication with the fluid supply line between the distributor and the fluid supply means. As an alternative to a pressure sac, a movable diaphragm may be used, if desired.

To avoid reverse flow of the fluid it is possible to include a one-way valve or like device in the supply line between the fluid supply means and the distributor inlet, if desired.

It will be appreciated that use of a press-responsive control means as described above allows the fluid supply means to be operated intermittently, since the supply means need only be switched on (i) during those portions of each cycle immediately following changeover to a new cell or group of cells, and (ii) only for as long as the fluid pressure in that cell or group of cells is below the predetermined minimum value. Thus, when a wheelchair, for example, is fitted with a control device of the invention for inflating an inflatable cushion as described above, the fluid supply means may only need to run for as little as 15% of the time, compared with conventional systems used in the context of mattresses for beds, whose fluid supply means run substantially continuously. This gives much improved power consumption and operating life, which is particularly important where, for example, wheelchairs require a portable battery power supply.

BRIEF INTRODUCTION OF THE DRAWINGS

Embodiments of the invention will now be described in further detail by way of non-limitative example, with reference to the accompanying drawings, in which:

FIG. 3 is a side elevational, part-sectional view of the control device embodying the invention, for the cushion of FIGS. 1 and 2;

FIG. 4 is a top plan, part-sectional view of control device of FIG. 3;

Figure 6A:
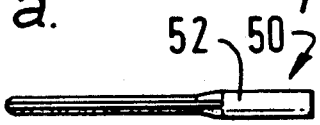
Figure 6B:
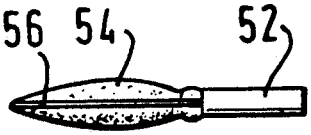
Figure 6C:
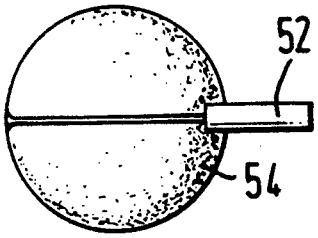
Figure 7:
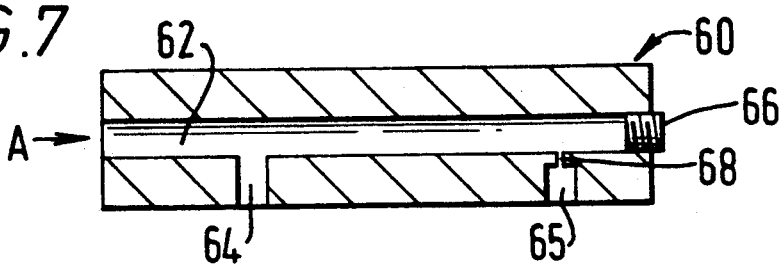
Figure 8:
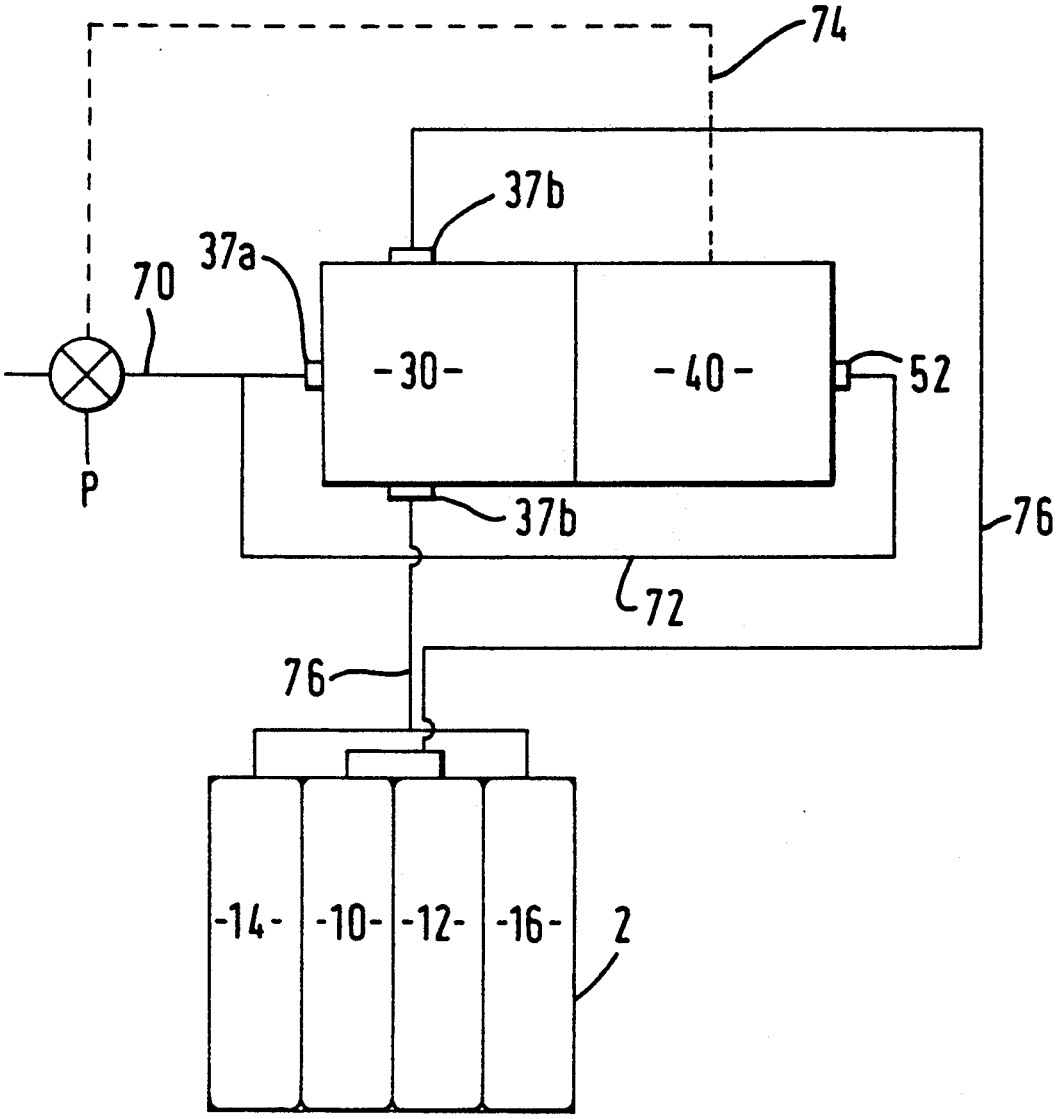

FIGS. 6(*a*)–(*c*) are side views of a preferred pressure sac in different stages of expansion, for use in the embodiment of FIG. 3;

FIG. 7 is a diagrammatic sectional view of a sampling block for use in the embodiment of FIG. 3; and FIG. 8 is a general diagram of the control device of FIG. 3 and the cushion to which it is connected.

DESCRIPTION OF THE PREFERRED EMBODIMENT

Figure 1:
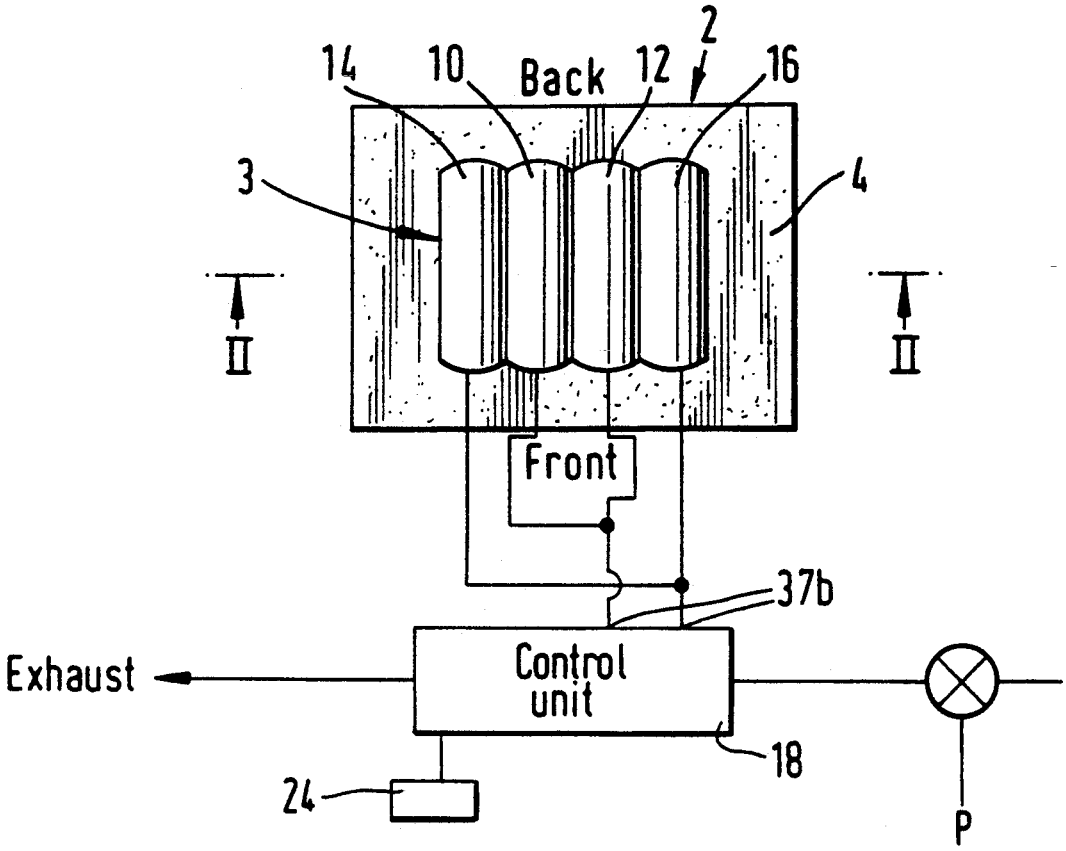
FIG. 1 is a plan view of a cushion for a seat of a wheelchair embodying the invention, the figure also showing how a control unit is connected to the cushion.

FIG. 1 shows the cushion 2 of a seat of a wheelchair. The cushion has a central region 3 which is four inflatable elongate parallel tubes 10, 12, 14, 16 arranged side by side in abutting relationship and oriented in a direction corresponding to the front to back direction of the chair seat. The size of the cushion 3 and the dimensions of the tubes 10, 12, 14, 16 are not limited and may be chosen to suit the particular use for which the cushion is desired. To provide additional stability for the tube array, the adjacent tubes may be bonded together by any suitable means e.g. adhesive. Each of the tubes 10, 12, 14, 16 is formed of an fluid-impermeable flexible material, for example polyurethane.

Figure 2:
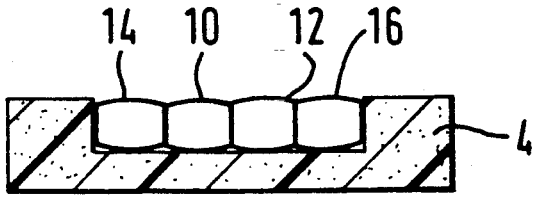
FIG. 2 is a cross-sectional view on line II—II of FIG. 1.
Figure 5:
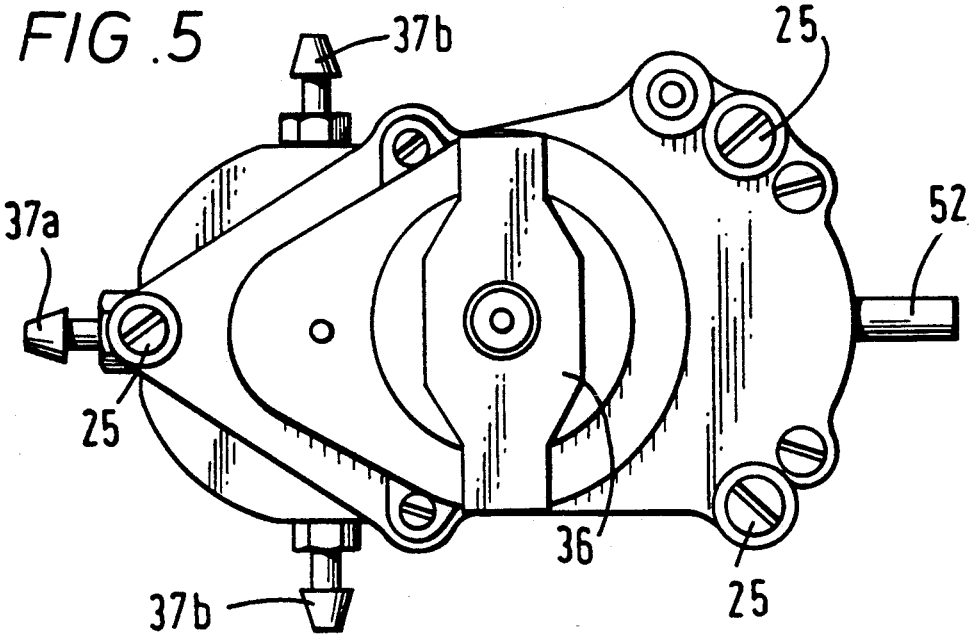
FIG. 5 is a bottom plan view of the control device of FIG. 3.

Around the periphery of the cushion is a frame in the form of a surround 4 of high density foam with a long memory. As seen in FIG. 2, this surround 4 extends beneath the inflatable tubes 10, 12, 14, 16, as well as around their sides, thereby forming a well in the central region of the cushion. This well assists in maintaining the stability of the inflatable tubes as they are inflated and deflated. The portions of the surround 4 around the tubes 10,12,14,16 at the same level as the tubes may alternatively be an inflatable ring-shaped tube which is kept permanently inflated by the inflation means described below.

The four tubes 10, 12, 14, 16 each have a single inlet/-outlet connection and are connected by air lines to a control unit indicated generally at 18. The control unit 18 regulates the inflation/deflation cycle of the tubes 10,12,14,16. The central pair of tubes 10 and 12 are connected to one outlet **37*b* of the control unit while the outside pair of tubes 14 and 16 are connected to a second outlet 37*b* of the control unit. A power supply 24 is provided. The control unit 18 controls an inflation pump P and also sequentially controls the inflation and deflation of the two groups of tubes, 10 and 12 and 14 and 16 respectively. Initially, one pair of tubes, for example tubes 10 and 12, are in the fully inflated condition, while tubes 14 and 16 are in the deflated condition. In this condition the tubes 10 and 12 provide a symmetrical support for a person seated in the wheelchair. After a predetermined period of time e.g. 7½ minutes, the control unit 18 supplies air from the pump P to tubes 14 and 16 which thus inflate. Once tubes 14 and 16 have reached their fully inflated condition, tubes 10 and 12 are deflated. Following this step of the sequence, therefore, the person's body is now supported symmetrically by tubes 14 and 16. Thus, the regions of the person's body surface in contact with the cushion and supporting the person's body weight are different, according to whether it is the first pair 10, 12 or second pair 14, 16** of tubes which are inflated.

The changeover to the condition where the first pair of tubes 10, 12 support the person's body weight is effected in a similar manner to that described above, i.e. with tubes 14 and 16 in the fully inflated condition, tubes 10 and 12 are inflated to their fully inflated condition, following which tubes 14 and 16 are allowed to deflate.

This whole sequence is repeated cyclically, so that when a person is seated in the wheelchair for a long period of time, no area of the body surface will support the body weight continuously.

Referring to FIG. 3, the control device, indicated generally as 18, comprises a combined distributor 30 and pressure-responsive actuator 40. The distributor 30, seen more clearly in FIG. 4, has a rotor 32 rotatable about an axis 33 within a stationary housing 34. The rotor 32 and housing 34 may be of any suitable material, for example metal or a plastics material such as ABS polymer.

Spaced apart around the periphery of the housing 34 are ports which allow communication between the interior of the housing 34 and the outside of the distributor. One port forms the distributor inlet **37*a* and is provided with an adaptor for connection by a tube to an inflating fluid supply means e.g. a conventional air compressor or pump (not shown in FIG. 3 but indicated schematically at P in FIGS. 1 and 8), and two further ports form distributor outlets 37*b*, each of which is provided with an adaptor. Each outlet 37*b* is connected by supply tubes to a different tube or group of tubes of the cushion (see FIG. 8). The rotor 32 is driven at a constant revolutionary speed by an electric motor and gearbox 36 through a drive shaft, not shown. As the rotor 32 rotates, the outlets 37*b* become connected to the inlet 37*a*** in sequence.

The rotor 32 contains internal passages arranged so that at any time at least one of the outlets **37*b* is connected to the inlet 37*a* and so that, on changeover from connection to one outlet 37*b* to the other outlet 37*b*, the two outlets 37*b* are connected to each other for a brief period. This allows the air from the already inflated group of tubes to help inflation of the uninflated group of tubes. When an outlet 37*b* is not connected to the inlet 37*a*, it is connected by the rotor passages to slots (not shown) in the housing 34** through which rapid deflation of the relevant group of tubes takes place.

As seen in FIGS. 3 and 4, the actuator 40 comprises a sensor 50 (illustrated in FIG. 6) which operates a microswitch formed by an actuator plate 48 and an electrical contact 49. The actuator plate 48 is biased towards the contact 49 by a spring 46. The spring pressure is adjustable by means of the bolt **46*a* on which the spring 46 is mounted. Within a chamber 44 beneath the actuator plate 48 is positioned an expandable pressure sac 54 of the pressure sensor 50. The sac 54 is made of light, air-impervious flexible PVC or other suitable material. Its diameter is about 25 mm. The interior of the pressure sac 54 is connected to an adaptor tube 52, which is also seen in FIGS. 3 and 4. To maintain the pressure sac 54 in position beneath the actuator plate 48, the sac 54 has a central support 56 connected at one end to the adaptor tube 52 and at the opposite end to the far end of the pressure sac 54. All the components of the microswitch are contained within a housing 27, for example of a plastics material such as ABS polymer, which in this embodiment is unitary with the housing 34 of the distributor 30**.

The distributor 30 and actuator 40 are mounted together on a chassis 25, which also carries the motor and gearbox 36. This allows the control device 18 to be assembled as a single component of the inflation system of the cushion.

The adaptor tube 52 of the pressure sensor 50 is connected to the inflating fluid supply line by a sampling block 60, which is shown in FIG. 7. This block is of metal or plastics.

The various inflating fluid supply tubes necessary for connecting together the various parts of the control device 18 and connecting the device to the fluid supply means P and the various tubes of the cushion are shown diagrammatically in FIG. 8, but any suitable spatial arrangement of the parts of the system may be used.

The sampling block 60 has a central longitudinal bore 62 and two secondary bores 64 and 65 transverse to and in fluid communication therewith. At one end of the longitudinal bore 62 is an adjustor 66, which may be adjusted to give the desired sensitivity of the device. The adjustor 66 may for example be a threaded screw, a bleed valve or other leakage device. The opposite end of the longitudinal bore 62 and the secondary bore 64 are connected respectively to the inflating fluid supply means P and the distributor inlet **37*a*. The secondary bore 65 is connected to the adaptor tube 52 of the pressure sensor 50. Unlike the junction between the secondary bore 64 and the longitudinal bore 62, the junction of the secondary bore 65 with the longitudinal bore 62 is by way of constriction 68. When air is used as the inflating fluid a typical size of constriction is 0.25 mm (0.010 inches). The restricted fluid flow into the pressure sac 54 thus produced gives rise to hysteresis in the internal pressure of the pressure sac 54**, which smooths the on and off switching of the fluid supply means P and avoids sudden surges in inflating fluid supply pressure. It may also ensure an even supply of inflating fluid to the tubes of the cushion by damping fluctuations in the fluid supply pressure.

The operation of the actuator 40 is further illustrated by reference to FIG. 6, which shows the three principal stages of inflation of the pressure sac 54 within the chamber 44 of the actuator. In FIG. 6(*a*) the pressure sac 54 is completely deflated, which condition arises when the pressure in the inflating fluid supply line (to which the pressure sensor 50 is connected) is at atmospheric pressure, as may be the case when the tube or group of tubes of the cushion connected at this point of the cycle of the distributor to the distributor inlet 37*a* is in the deflated condition.

In FIG. 6(*b*) the pressure sac 54 has just begun to inflate, as may be the case just after the distributor has connected a deflated tube or group of tubes of the cushion to the inlet 37*a*, since upon making that connection, the pressure sensor 50 sampling the pressure in that tube or group of tubes will have actuated the microswitch, thereby switching on the fluid supply means P. The fluid supply means will continue to inflate that tube or group of tubes of the cushion until its internal pressure reaches the predetermined minimum, when it will have reached the correct inflation for supporting a person's body weight. The pressure sac 54 will progress towards its maximum expansion, which condition is shown in FIG. 6(*c*). At the desired pressure in the inlet 37*a* the electrical contact in the microswitch is broken by the sac 34, and the fluid supply means P switched off, so that delivery of inflating fluid to that tube or group of tubes ceases. This tube or group of tubes thus remains in its inflated and supporting condition until at least the end of the respective portion of the cycle, at which point switchover to the tube or group of tubes connected to the other distributor outlet 37*b* occurs and the next portion of the cycle commences. It is during this next portion of the cycle that the preceding tube or group of tubes is deflated. Preferably the preceding tube or group of tubes does not deflate until after the succeeding tube or group of tubes has completed its inflation, in order to maintain the cushion at all times in a supporting condition for a person's body.

FIG. 8 shows diagrammatically the distributor 30 and actuator 40 described above, the pump P supplying pressurised air to the inlet 37*a* of the distributor via a line 70 and the connection 72 between the adaptor 52 of the actuator 40 and the line 70 close to the inlet 37*a* of the distributor. A broken line 74 indicates the electrical connection between the actuator 40 and the pump P by which the on-off control of the pump is effected. The distributor outlets 37*b* are connected via lines 76 to the respective groups of inflatable tubes of the cushion 2. These are four tubes in this case, the inner pair 10, 12 constituting one group are inflated together and the outer pair 14, 16 the second group inflated together, as described above.

Although the cushion of the invention has been described with particular reference to wheelchairs, it is to be understood that it is applicable also to other kinds of chair.

We claim:

1. A cushion for a seat of a chair comprising:

at least a first central formation and a second side formation, said formation being formed of a series of positive pressure inflatable tubes arranged in a side-by-side relationship and longitudinally oriented in a direction corresponding to a front-to-back direction of the seat, said second formation including at least two said tubes spaced apart symmetrically with respect to a central line of the cushion extending in the front-to-back direction of the chair, and said first formation including at least one said tube, said first formation being located between said two spaced apart tubes of said second formation;

a control means for cycling said formations in a predetermined sequence between a fully inflated positive pressure state and a deflated state of every said tube of each said formation and for cycling said formation only with a first time period in which all of said tubes of said first and second formations are fully inflated simultaneously and a second time period for each said formation in which one said formation is deflated while the other is fully inflated; and said formation being selected and arranged so that at all states of said predetermined sequence said tubes provide symmetrical support for a person's body seated on the chair with respect to said central line of the cushion extending in the front-to-back direction of the chair.

2. A cushion according to claim 1 wherein each said second time period is immediately succeeded by a said first time period.

3. A cushion according to claim 1 wherein said first and second formations comprise an array of four said tubes side-by-side, two inner tubes of the array forming said first formation and the two outer tubes forming said second formation.

4. A cushion according to claim 1 having support means to maintain the alignment of the tubes.

5. A cushion according to claim 4 wherein said support means comprises a supporting material which forms a surrounding frame for the tubes.

6. A cushion according to claim 5 wherein said support means additionally comprises a base such that the tubes lie in a well in a central region formed by said base and said surrounding frame.

7. A cushion according to claim 1 wherein said control means has:

a pressurised fluid supply means, a pressurised fluid distributor having an inlet connected to said fluid supply means, a plurality of outlets connectible to said formations and a means for sequentially connecting said inlet to said outlets to effect inflation of said formations in a predetermined sequence, and a pressure-responsive means for said fluid supply means, having a sensor of pressure at said inlet of said distributor and being arranged to control said fluid supply means in dependence on said pressure sensed by said sensor.

8. A cushion for a seat of a chair comprising:

at least a first central formation and a second side formation, said formations being formed of a series of positive pressure inflatable tubes arranged in a side-by-side relationship and longitudinally oriented in a direction corresponding to a front-to-back direction of the seat, said second formation including at least two said tubes spaced apart symmetrically with respect to a central line of the cushion extending in the front-to-back direction of the chair, and said first formation including at least two adjacent ones of said tubes, said first formation being located between said two spaced apart tubes of said second formation;

a control means for cycling said formations in a predetermined sequence between a fully inflated positive pressure state and a deflated state of every said tube of each said formation and for cycling said formations only with a first time period in which all of said tubes of said first and second formations are fully inflated simultaneously and a second time period for each said formation in which one said formation is deflated while the other is fully inflated; and said formations being selected and arranged so that at all states of said predetermined sequence said tubes provide symmetrical support for a person's body seated on the chair with respect to said central line of the cushion extending in the front-to-back direction of the chair.

* * * * *